US008403654B2

(12) United States Patent
Podesta et al.

(10) Patent No.: US 8,403,654 B2
(45) Date of Patent: Mar. 26, 2013

(54) LOW FUEL PERMEATION PRIMER BULB

(75) Inventors: James Ray Podesta, Tulsa, OK (US); Robert Denton, Tulsa, OK (US); Benny R. Foreman, Broken Arrow, OK (US)

(73) Assignee: RL Hudson & Company, Broken Arrow, OK (US)

( * ) Notice: Subject to any disclaimer, the term of this patent is extended or adjusted under 35 U.S.C. 154(b) by 287 days.

(21) Appl. No.: 12/751,526

(22) Filed: Mar. 31, 2010

(65) Prior Publication Data

US 2011/0240153 A1 Oct. 6, 2011

(51) Int. Cl.
*F02M 1/16* (2006.01)

(52) U.S. Cl. ..... 417/478; 417/472; 417/480

(58) Field of Classification Search ..... 417/472, 417/478, 480, 92, 48
See application file for complete search history.

(56) References Cited

U.S. PATENT DOCUMENTS

| | | | | |
|---|---|---|---|---|
| 247,142 | A | 9/1881 | Woods | |
| 523,345 | A | 7/1894 | Hardman, Jr. | |
| 723,042 | A * | 3/1903 | Schwerin | 417/478 |
| 1,352,306 | A * | 9/1920 | Mott | 417/478 |
| 2,648,288 | A * | 8/1953 | Marks | 417/478 |
| 2,954,048 | A | 9/1960 | Rychlik | |
| 3,233,610 | A * | 2/1966 | Wade | 417/478 |
| 3,676,026 | A * | 7/1972 | Tupper et al. | 417/560 |
| 3,987,775 | A * | 10/1976 | O'Connor | 123/179.11 |
| 4,012,178 | A * | 3/1977 | Puckett | 417/478 |
| 4,185,579 | A * | 1/1980 | Asher | 73/864.62 |
| 4,936,298 | A * | 6/1990 | Nishina et al. | 128/205.13 |
| 5,089,014 | A * | 2/1992 | Holfert | 623/1.24 |
| 5,970,935 | A * | 10/1999 | Harvey et al. | 123/179.11 |
| 6,180,889 | B1 * | 1/2001 | Bul | 174/121 R |
| 6,889,519 | B2 * | 5/2005 | Knowles | 62/292 |
| 7,021,195 | B2 * | 4/2006 | Proust | 92/92 |
| 7,484,942 | B2 | 2/2009 | Proust | |
| 2009/0199806 | A1 | 8/2009 | Brown et al. | |

* cited by examiner

*Primary Examiner* — Devon Kramer
*Assistant Examiner* — Andrew A Horton
(74) *Attorney, Agent, or Firm* — Fellers, Snider, Blankenship, Bailey & Tippens, P.C.; David G. Woodral

(57) ABSTRACT

A fuel primer is disclosed. The primer includes a rigid valve body having first and second ends with first and second check valves therein. The pump also includes an elastic and substantially fuel impermeable bulb substantially encasing the rigid valve body and sealing to the valve body proximate the first and second check valves.

18 Claims, 3 Drawing Sheets

LOW FUEL PERMEATION PRIMER BULB

FIELD OF THE INVENTION

This disclosure is related to fuel systems in general and, more particularly, to priming bulbs for fuel systems.

BACKGROUND OF THE INVENTION

Fuel lines or hoses may have a need to be primed, or pre filled, before they may be used for reliable fuel delivery, either by pumping or engine vacuum. One type of device useful for priming fuel lines is a hand-operated primer bulb or pump. Primer bulbs may be molded using Epichlorohydrin (ECO) elastomers which have sufficient elongation to permit demolding from mold cores. ECO has moderate resistance to fuel but poor fuel vapor permeation.

What is needed is a device for addressing the above, and related, issues.

SUMMARY OF THE INVENTION

The invention of the present disclosure, in one aspect thereof, comprises a fuel primer. The primer includes a rigid valve body having first and second ends with first and second check valves therein. The pump also includes an elastic and substantially fuel impermeable bulb substantially encasing the rigid valve body and sealing to the valve body proximate the first and second check valves. The bulb may be made from a fluoroelastomer.

In some embodiments, the rigid valve body provides first and second fuel hose fittings on the first and second ends thereof, respectively, and the rigid valve body directs fuel flow from and to first and second hose fittings to the first and second check valves, respectively. In some embodiments the first check valve allows fuel into the bulb and the second check valve allows fuel out of the bulb. The first fitting may have a larger diameter than the second fitting.

DETAILED DESCRIPTION OF THE PREFERRED EMBODIMENTS

Figure 1:
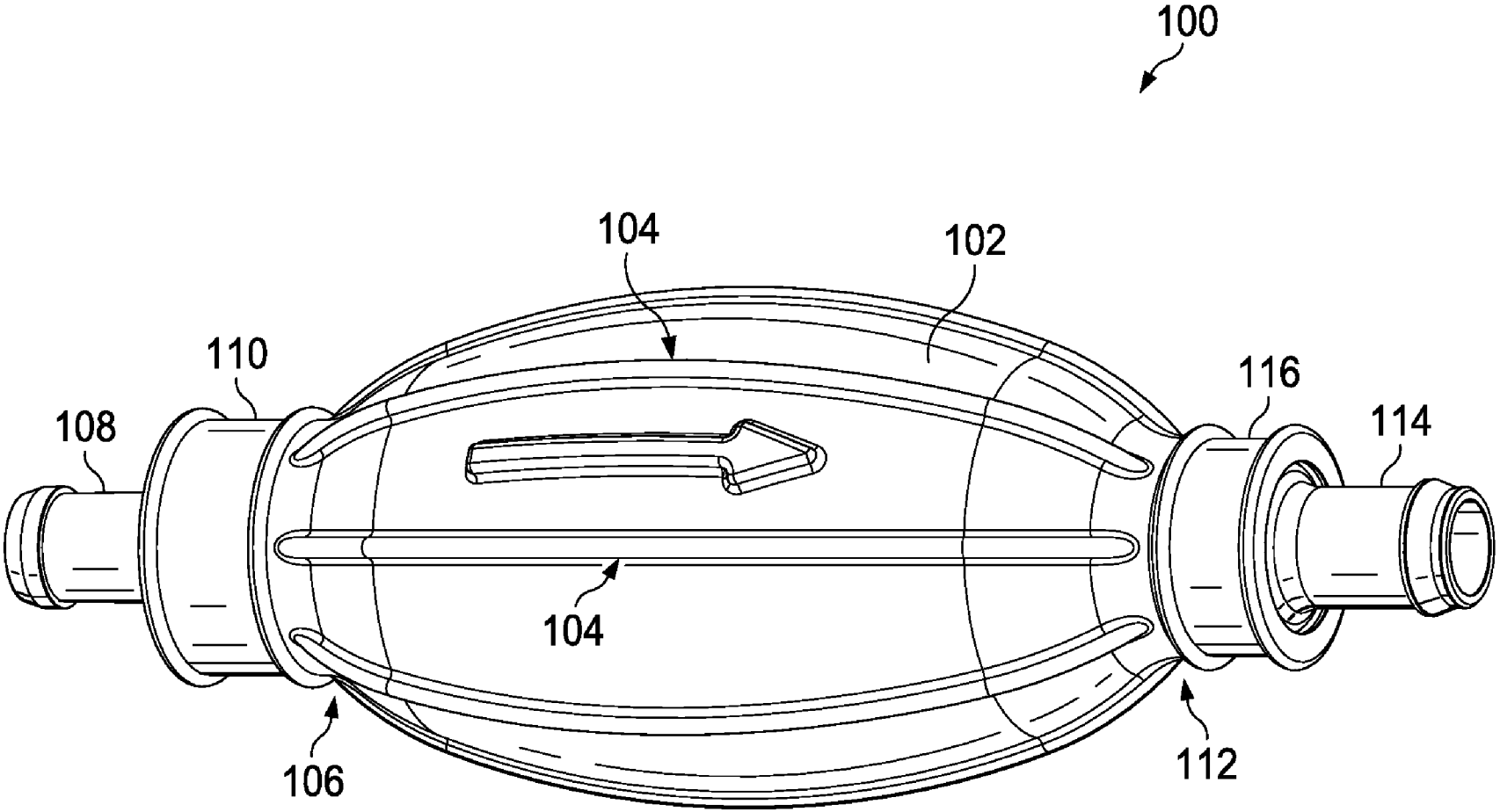
FIG. 1 is a perspective view of a low permeability fuel primer bulb according to aspects of the present disclosure.

Referring now to FIG. 1, a perspective view of a low permeability fuel primer bulb according to aspects of the present disclosure is shown. The device 100 may be considered as a hand-operated fuel pump for priming or filling a fuel hose. From the viewpoint of FIG. 1, it can be seen that the primer pump bulb 100 includes a flexible bulb 102. The bulb 102 may be a fluoroelastomeric material that has a high degree of resistance to permeation by motor fuels and vapors. One example of such a fluoroelastomer is Viton®. The bulb 102 may have one or more ridges 104 or other features to provide a more textured surface for gripping by the user's hand.

A first end 106 of the bulb 102 provides a first fuel hose fitting 108. The first hose fitting 108 proceeds from and is surrounded by a first annulus 110 on the first end 106 of the bulb 102. A second end 112 of the bulb 102 provides a second fuel hose fitting 114 surrounded by annulus 116. It will be appreciated that the hose fittings 108, 114 may be any type or size of available hose fittings. These include, but are not limited to, press on fittings, clamp fittings, and quick connect fittings. The fittings 108, 114 may be constructed from any suitably fuel resistant material including polymers, rubbers, or metals.

Figure 2:
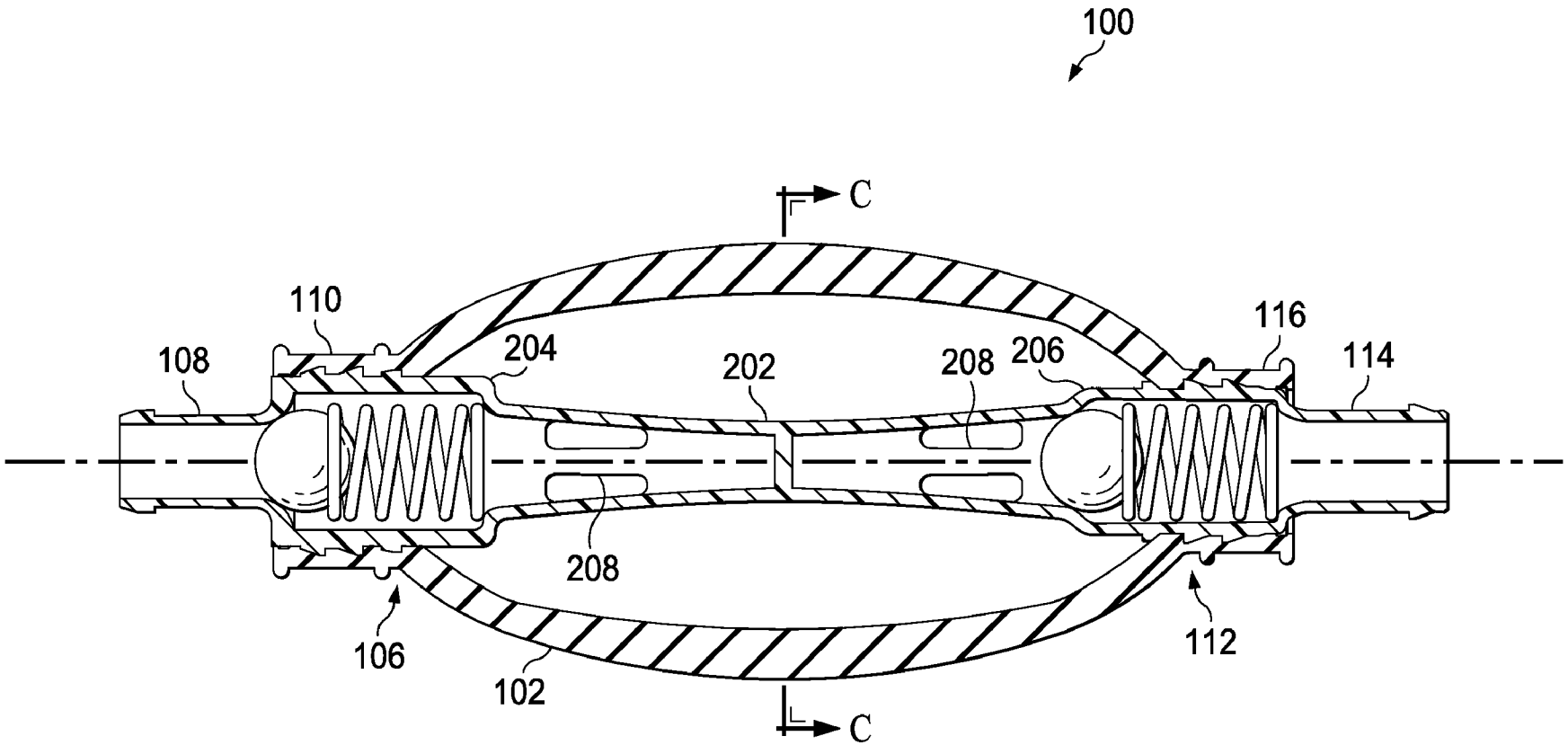
FIG. 2 is a side cutaway view of the primer bulb of FIG. 1.

Referring now to FIG. 2, a side cutaway view of the primer bulb pump of FIG. 1 is shown. From the cutaway view, a valve body 202 can be seen and, in the present embodiment, integrates a first check valve 204 and a second check valve 206. In the present embodiment, the check valves 204, 206 are configured within the valve body 202 to allow fuel flow in only one direction from the first end 106 of the bulb 102 to the second end 112. In the present embodiment, the check valves 204, 206 are ball-and-spring type check valves, but other types of check valves may also be utilized. In the present embodiment, the check valves 204, 206 are at least partially integrated with the valve body 202. The check valves 204, 206 may have internal components that are retained within the valve body 202 by the respective hose fittings 108, 114. The valve body may be constructed of any suitably fuel resilient material, including polymers, rubbers, and metals.

In addition to providing a secure attachment point for the check valves 204, 206, the valve body 202 also serves as a resilient and crush resistant member inside the bulb 102. As will be described in greater detail below, the primer pump bulb 100 may be part of a small engine fuel system, and may have hoses connected at one or both of the hose fittings 108, 114. As such, the primer pump 100 may be subject to bending forces as the attached hoses are coiled for storage. The valve body 202 will prevent the bulb 102 from being kinked, bent, or otherwise damaged when the attached hoses are coiled.

In operation, the bulb 102 is pressurized on the interior by pressure from a user's hand on the outside. This pressure will cause fuel to flow through the check valve 206 and out the hose fitting 114. As pressure is released from the bulb 102, a vacuum is created in the interior of the bulb, which will tend to draw fuel in through check valve 204 into the interior of the bulb 102. The cycle will then repeat until the attached hoses are sufficiently primed for operation. It can be seen that the valve body 202 provides a number of holes or perforations 208 that allow fuel to freely flow through one check valve to another via the interior of the bulb 102. Another function provided by the valve body 202 is to prevent the bulb 102 from being over compressed and collapsing to a state that does not readily return to shape during use.

From the viewpoint of FIG. 2, it can also be seen that relatively few parts are required for assembly of the device 100. A single component, the valve body 202, serves as a part of the check valves 204, 206 as well as a crush resistant resilient member inside the bulb 102. In the present embodiment, the springs and balls of the check valves 204, 206 fit directly into the ends of the valve body 202. The hose fittings 108, 114 may be ultrasonically welded to the valve body 202 to retain the components of the check valves 204, 206.

The outer diameter of the valve body 202 near the first end 106 of the device 100 may be slightly larger than the diameter of the valve body 202 near the second end 112 of the device 100. By constructing the bulb to have a first annulus 110 slightly larger than the second annulus 116, the bulb 102 may be constructed as a single piece, and fitted to the valve body 102 from the second end to the first end. This also reduces the amount of relatively expensive fluoroelastomeric material needed in the bulb 102. Producing a bulb having one annulus larger than the other also aids in manufacturing of the bulb itself by reducing the amount of stretch the bulb 102 undergoes when being removed from a mold core.

Figure 3:
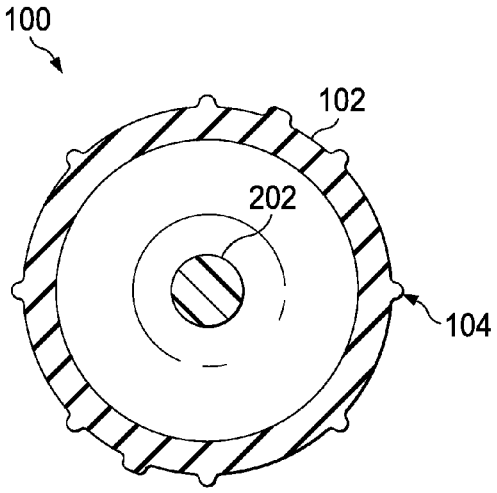
FIG. 3 is a transverse cutaway view of the primer bulb of FIG. 1.

Referring now to FIG. 3, a transverse cutaway view of the primer bulb of FIG. 1 is shown. The viewpoint of FIG. 3 is taken along the section line CC as shown in FIG. 2. Here, the fluoroelastomeric bulb 102 can be shown approximately equidistantly surrounding the center of the valve body 202. Ridges 104 are also shown and are provided for an increased grip of the bulb 100, particularly in wet environments where the device 100 may be used.

Figure 4:
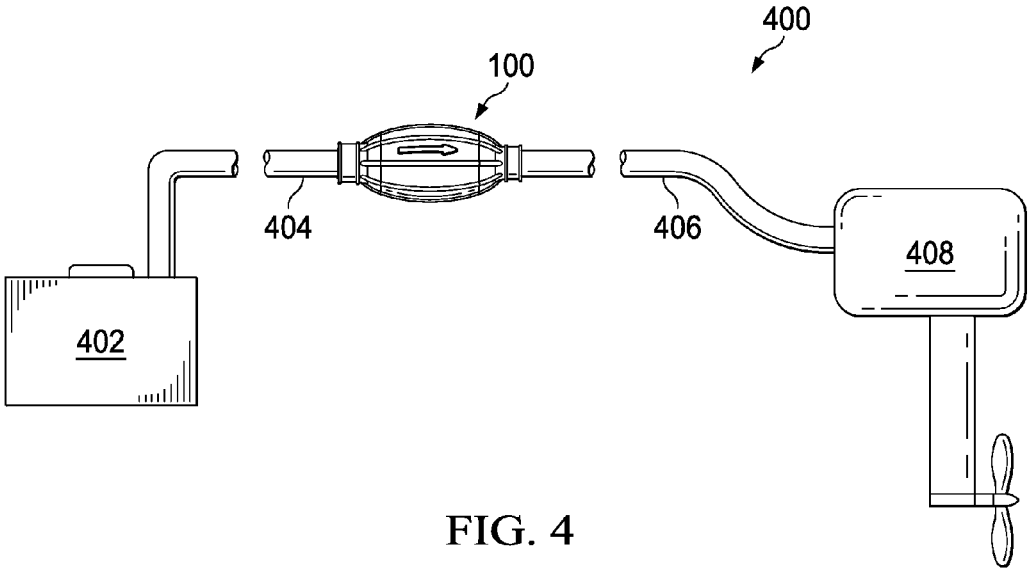
FIG. 4 is a view of an engine and fuel supply utilizing a low permeability primer bulb according to aspects of the present disclosure.

Referring now to FIG. 4, a view of an engine and fuel supply utilizing a low permeability primer bulb pump according to aspects of the present disclosure is shown. The viewpoint 400 of FIG. 4 illustrates one possible use for the primer bulb pump 100 described herein. A fuel cell 402 may be provided, that may be refillable. A hose 404 may connect the fuel cell 404 to the first end of the primer pump 100. A second hose 406 may connect the primer pump 100 to an engine or other fuel consumption device. In operation, when the hoses have been attached as shown, the engine 408 may not be able to draw a sufficient amount of fuel from the fuel cell 402 unless the hoses 404, 406 are adequately primed with fuel. Activation of squeezing the pump 100 will serve to draw fuel from the fuel cell 402 through the primer pump 100 and to the engine 408. As previously described, the internal check valves 206, 204 serve to fuel to proceed only in one direction from the fuel cell 402 to the engine 408.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A primer bulb comprising:

a rigid and crush resistant valve body;

a first check valve attached in a first end of the valve body;

a second check valve attached in a second end of the valve body; and a flexible and resilient bulb substantially covering the valve body and sealing to the valve body such that the check valves will substantially block fluid flow in one direction; and wherein the valve body defines a partition on an interior thereof between the first and second check valves, and defines at least one opening into the interior proximate each of the check valves, such that fluid flowing from one valve to the other must exit and re-enter the valve body via the openings.

2. The primer bulb of claim 1, wherein the flexible and resilient bulb comprises a fluoroelastomer.

3. The primer bulb of claim 1, wherein the flexible and resilient bulb is substantially sealed to the rigid and crush resistant valve body proximate the first and second ends thereof and is detached and flexible therebetween.

4. The primer bulb of claim 1, wherein the rigid and crush resistant valve body comprises a plastic structure maintaining the first and second check valves in a fixed relationship to one another and allowing fluid flow to and from the check valves.

5. The primer bulb of claim 4, wherein the rigid and crush resistant valve body provides first and second hose fittings proximate the first and second check valves, respectively.

6. A fuel primer comprising:

a hollow valve body having first and second ends with first and second check valves therein, and defining a partition on an interior thereof between the first and second check valves and at least one opening on the hollow body proximate each of the first and second check valves, the valve body maintaining the first and second check valves in a fixed relationship relative to one another and allowing fluid flow to and from the check valves by exiting and re-entering the openings in the body; and an elastic and substantially fuel impermeable bulb substantially encasing the valve body and sealing to the valve body proximate the first and second check valves;

wherein the first end of the valve body has a larger diameter than the second end of the valve body; and wherein the valve body comprises a material that is more rigid and less elastic than the elastic and fuel impermeable bulb such that the valve body does not bend or compress in response to hand pressure.

7. The fuel primer of claim 6, wherein the valve body provides first and second fuel hose fittings on the first and second ends thereof, respectively, the valve body directing fuel flow from and to first and second hose fittings to the first and second check valves, respectively.

8. The fuel primer of claim 6, wherein the elastic and substantially fuel impermeable bulb comprise a fluoroelastomer.

9. The fuel primer of claim 6, wherein the first end of the valve body provides a first fitting for the elastic and substantially fuel impermeable bulb and the second end of the rigid valve body provides a second fitting for the elastic and substantially fuel impermeable bulb.

10. The fuel primer of claim 6, wherein the first check valve allows fuel into the elastic and substantially fuel impermeable bulb and the second check valve allows fuel out of the elastic and substantially fuel impermeable bulb.

11. The fuel primer of claim 6, wherein the rigid valve body provides fuel hose fittings that project through the elastic and substantially fuel impermeable bulb proximate the check valves.

12. The fuel primer of claim 6, wherein the valve body comprises a plastic.

13. The fuel primer of claim 6, wherein the valve body comprises a metal.

14. A fuel system comprising:

a refillable liquid fuel cell;

a fuel primer having first and second hose fittings attached to a substantially hollow rigid valve body that defines an interior partition, the fuel primer providing first and second check valves configured to allow fuel into the first fitting and out of the second fitting by exiting the hollow body through an opening defined therein proximate the first fitting and re-entering the hollow body through an opening defined therein proximate the second fitting, the fuel primer also having a fluoroelastomeric bulb substantially enclosing the rigid valve body and configured to apply pressure and vacuum internally to the rigid valve body in response to manual manipulation;

a first fuel hose connecting the fuel cell to the first fitting; and a second fuel hose connected to the second fitting.

15. The fuel system of claim 14, wherein the second fuel hose is attached to an engine.

16. The fuel system of claim 14, wherein the rigid valve body provides a first end receiving the first check valve and having a first diameter for receiving the fluoroelastomeric bulb, and a second end receiving the second check valve and having a second diameter for receiving the bulb.

17. The fuel system of claim 16, wherein the first diameter is greater than the second diameter.

18. The fuel system of claim 14, wherein the first and second check valves comprise ball and spring valves.

* * * * *